US011434097B2

(12) United States Patent
Ricco'

(10) Patent No.: US 11,434,097 B2
(45) Date of Patent: Sep. 6, 2022

(54) MAGAZINE UNIT FOR A PACKAGING MACHINE, PACKAGING MACHINE HAVING A MAGAZINE UNIT AND METHOD FOR LOADING A MAGAZINE UNIT

(71) Applicant: TETRA LAVAL HOLDINGS & FINANCE S.A., Pully (CH)

(72) Inventor: Marco Ricco', Spilamberto (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 103 days.

(21) Appl. No.: 16/769,857

(22) PCT Filed: Jan. 18, 2019

(86) PCT No.: PCT/EP2019/051210
§ 371 (c)(1),
(2) Date: Jun. 4, 2020

(87) PCT Pub. No.: WO2019/145222
PCT Pub. Date: Aug. 1, 2019

(65) Prior Publication Data

US 2021/0171305 A1 Jun. 10, 2021

(30) Foreign Application Priority Data

Jan. 29, 2018 (EP) ..... 18153848

(51) Int. Cl.
*B65H 19/30* (2006.01)
*B65H 19/22* (2006.01)

(52) U.S. Cl.
CPC ..... *B65H 19/305* (2013.01); *B65H 19/2284* (2013.01); *B65H 2301/41734* (2013.01)

(58) Field of Classification Search
CPC .. B65H 19/30; B65H 19/305; B65H 19/2284; B65H 2301/41734
See application file for complete search history.

(56) References Cited

U.S. PATENT DOCUMENTS 1,574,851 A 3/1926 Seymour
3,360,209 A 12/1967 De
(Continued)

FOREIGN PATENT DOCUMENTS

EP 0283086 A2 9/1988

OTHER PUBLICATIONS

International Search Report (PCT/ISA/210) dated Apr. 15, 2019, by the European Patent Office as the International Searching Authority for International Application No. PCT/EP2019/051210.
(Continued)

*Primary Examiner* — Sang K Kim
(74) *Attorney, Agent, or Firm* — Buchanan Ingersoll & Rooney PC

(57) ABSTRACT

There is described a magazine unit for a packaging machine comprising an inlet opening configured to allow for the introduction of a spindle carrying a wound-up web of packaging material into the magazine unit, at least one pair of housing seats configured to rotatably support the spindle carrying the wound-up web of packaging material, the respective housing seats being arranged side-by-side and distanced from the inlet opening, and a pair of guide rails, the guide rails being arranged side-by-side and each one extending from the inlet opening to one respective housing seat and being configured to guide the spindle from the inlet opening to the pair of housing seats.

19 Claims, 5 Drawing Sheets

(56) References Cited

U.S. PATENT DOCUMENTS

| | | | | |
|---|---|---|---|---|
| 4,165,842 | A * | 8/1979 | Mengel | B65H 19/1815 242/554.2 |
| 4,392,912 | A | 7/1983 | Horsley | |
| 4,729,519 | A * | 3/1988 | Tafel | B65H 19/1821 242/418.1 |
| 4,821,973 | A * | 4/1989 | Tafel | B65H 19/1821 156/353 |
| 5,186,408 | A | 2/1993 | Planeta | |
| 6,047,916 | A | 4/2000 | Oennerloev | |
| 2003/0089817 | A1 | 5/2003 | Hanson et al. | |
| 2004/0118964 | A1* | 6/2004 | Long | B65H 19/1836 242/554.2 |
| 2009/0294570 | A1 | 12/2009 | Wenk | |
| 2010/0264248 | A1* | 10/2010 | Butterworth | B65H 19/1847 242/552 |
| 2011/0206439 | A1 | 8/2011 | Takahashi | |

OTHER PUBLICATIONS

Written Opinion (PCT/ISA/237) dated Apr. 15, 2019, by the European Patent Office as the International Searching Authority for International Application No. PCT/EP2019/051210.

* cited by examiner

MAGAZINE UNIT FOR A PACKAGING MACHINE, PACKAGING MACHINE HAVING A MAGAZINE UNIT AND METHOD FOR LOADING A MAGAZINE UNIT

TECHNICAL FIELD

The present invention relates to a magazine unit for a packaging machine, in particular a packaging machine for producing sealed packages of a pourable product, even more particular of a pourable food product.

The present invention also relates to a packaging machine, in particular a packaging machine for producing sealed packages of a pourable product, even more particular of a pourable food product.

The present invention also relates to a method for loading a magazine unit of a packaging machine, in particular a packaging machine for producing sealed packages of a pourable product, even more particular of a pourable food product.

BACKGROUND ART

As is known, many liquid or pourable food products, such as fruit juice, UHT (ultra-high-temperature treated) milk, wine, tomato sauce, etc., are sold in packages made of sterilized packaging material.

A typical example is the parallelepiped-shaped package for liquid or pourable food products known as Tetra Brik Aseptic (registered trademark), which is made by sealing and folding laminated strip packaging material. The packaging material has a multilayer structure comprising a base layer, e.g. of paper, covered on both sides with layers of heat-seal plastic material, e.g. polyethylene. In the case of aseptic packages for long-storage products, such as UHT milk, the packaging material also comprises a layer of oxygen-barrier material, e.g. an aluminum foil, which is superimposed on a layer of heat-seal plastic material, and is in turn covered with another layer of heat-seal plastic material forming the inner face of the package eventually contacting the food product.

Packages of this sort are normally produced on fully automatic packaging machines, which advance a web of packaging material from a magazine unit through a sterilization unit for sterilizing the web of packaging material, e.g. by means of chemical sterilization (e.g. by applying a chemical sterilizing agent, such as a hydrogen peroxide solution) or physical sterilization (e.g. by means of an electron beam). Then, the sterilized web of packaging material is maintained and advanced within an isolation chamber (a closed and sterile environment), and is folded and sealed longitudinally to form a tube having a longitudinal seam portion, which is further fed along a vertical advancing direction.

In order to complete the forming operations, the tube is filled with a sterilized or sterile-processed pourable food product, and is transversally sealed and subsequently cut along equally spaced transversal cross sections within a packaging unit of the packaging machine during advancement along the vertical advancing direction.

Pillow packages are so obtained within the packaging machine, each pillow package having a longitudinal sealing band, a top transversal sealing band and a bottom transversal sealing band.

A typical packaging machine for producing the packages comprises:

- a magazine unit providing for the web of packaging material;
- conveying means for advancing the web of packaging material along a web advancement path from the magazine unit to a forming station, at which, in use, the web of packaging material is formed into a tube;
- a sterilizing unit for sterilizing the web of packaging material;
- a tube forming device arranged within an isolation chamber and being adapted to form the tube from the advancing web of packaging material;
- a sealing device for longitudinally sealing the tube;
- a filling device for filling the tube with the pourable product; and
- a package forming unit adapted to produce the single packages from the tube by shaping, transversally sealing and transversally cutting the packages.

A typical magazine unit comprises an inlet opening through which a spindle carrying in a wound-up manner the web of packaging material can be introduced into the magazine unit and at least one pair of housing seats configured to rotatably support the spindle carrying the wound-up web of packaging material, the respective housing seats being arranged side-by-side and distanced from the inlet opening so that the wound-up web of packaging material can be retained within the magazine unit.

In particular, each pair of housing seats is arranged such that the spindle has a horizontal orientation with the spindle being placed within the respective pair of housing seats.

Typically, the wound-up web of packaging material, which is carried by the respective spindle is provided in form of a reel. It is furthermore known that a in a production hall a plurality of reels of the web of packaging material are vertically stacked so that each reel can be loaded into the packaging machine, in particular the magazine unit when necessary. Prior to the actual loading of one reel into the magazine unit, the respective reel must be removed from the stack and must be placed within the magazine unit.

It is known that this loading follows a two-step process.

During a first step of the loading of the magazine unit a first cart having two parallel handling arms clamps one respective reel of the web of packaging material between the two respective handling arms and lifts the respective reel up. After that the first cart is moved so as to distance the clamped reel from the other reels. Then the handling arms are turned so as to rotate the clamped reel around an angle of 90°. After that a respective spindle is guided through a respective through-hole of the respective reel so that the spindle carries the reel of web of packaging material. The spindle has a horizontal orientation.

After, during a second step of the loading of the magazine unit, a second cart is approached towards the reel clamped between the handling arms of the first cart. The second cart comprises two parallel side arms, each one carrying a respective seat for receiving a respective engagement portion of the spindle. Then the spindle together with the reel of web of packaging material is transferred to the second cart, in particular by the respective engagement portions of the spindle being placed within the respective seats. After that the second cart together with the spindle and the reel of the web of packaging material is guided to the magazine unit. The second cart is controlled such that the side arms protrude into the magazine unit and then the spindle is placed into the pair of housing seats of the magazine unit. After that the second cart is removed from the magazine unit.

Even though the known packaging machines, in particular the known magazine units, work satisfyingly well, the need is felt in the sector to further improve the known packaging machines, in particular the known magazine units.

In particular, the need is felt to improve the magazine unit so as to facilitate the process of loading the magazine unit.

DISCLOSURE OF INVENTION

It is therefore an object of the present invention to provide a magazine unit for a packaging machine to overcome, in a straightforward and low-cost manner, at least one of the aforementioned drawbacks.

In particular, it is an object of the present invention to provide a magazine unit, which can be loaded in an easy and fast manner.

It is a further object of the present invention to provide a packaging machine having a magazine unit to overcome, in a straightforward and low-cost manner, at least one of the aforementioned drawbacks.

It is a further object of the present invention to provide for a method for loading a magazine unit of a packaging machine to overcome, in a straightforward and low-cost manner at least one of the aforementioned drawbacks.

According to the present invention, there is provided a magazine unit as claimed in claim 1.

According to the present invention, there is also provided a packaging machine according to claim 10.

According to the present invention, there is also provided a method for loading a magazine unit according to claim 11.

Preferred embodiments are claimed in the dependent claims.

BRIEF DESCRIPTION OF THE DRAWINGS

A non-limiting embodiment of the present invention will be described by way of example with reference to the accompanying drawings, in which.

BEST MODES FOR CARRYING OUT THE INVENTION

Figure 1:
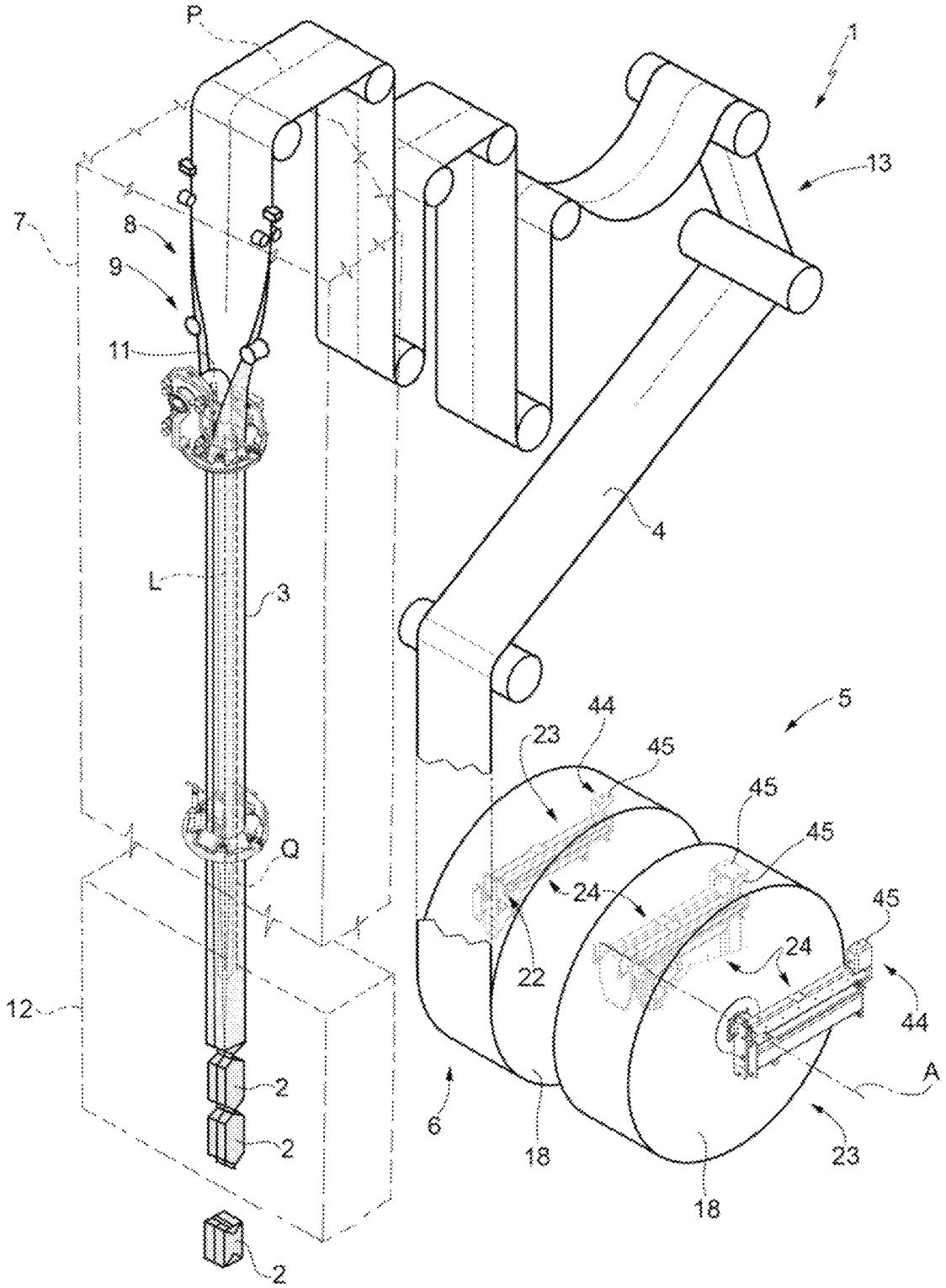
FIG. 1 is a schematic view of a packaging machine for packaging a pourable product, with parts removed for clarity.

Number 1 indicates as a whole a packaging machine for producing sealed packages 2 of a pourable product, in particular a pourable food product such as pasteurized milk, fruit juice, wine, tomato sauce, etc., from a tube 3 of a web 4 of packaging material. In particular, in use, tube 3 extends along a longitudinal axis L, in particular, axis L having a vertical orientation.

Web 4 of packaging material has a multilayer structure (not shown). Web 4 comprises a respective layer of fibrous material, normally paper, covered on both sides with respective layers of heat-seal plastic material, e.g. polyethylene.

Preferably, web 4 also comprises a respective layer of gas- and light-barrier material, e.g. aluminum foil or ethylene vinyl alcohol (EVOH) film, and at least one respective first layer and a respective second layer of heat-seal plastic material. The respective layer of gas- and light-barrier material is superimposed on the respective first layer of heat-seal plastic material, and is in turn covered with the second layer of heat-seal plastic material. The second layer of heat-seal plastic material forms the inner face of package 2 eventually contacting the filled food product.

A typical package 2 obtained by packaging machine 1 comprises a longitudinal seam portion and a pair of transversal sealing bands, in particular a transversal top sealing band and a transversal bottom sealing band.

With particular reference to FIG. 1, packaging machine 1 comprises:

- a magazine unit 5 for providing for web 4 in the area of a host station 6;
- an isolation chamber 7 separating an inner environment, in particular an inner sterile environment, from an outer environment;
- a tube forming device 8 extending along a longitudinal axis, in particular having a vertical orientation, and being arranged, in particular at a forming station 9, at least partially, preferably fully, within isolation chamber 7 and being adapted to form tube 3 from the, in use, advancing web 4;
- a sealing device (not shown and known as such) at least partially arranged within isolation chamber 7 and being adapted to longitudinally seal tube 3 formed by tube forming device 8 so as to form a longitudinal seam portion of tube 3;
- filling means 11 for filling tube 3 with the pourable product;
- a package forming unit 12 adapted to at least form and transversally seal tube 3, in particular the, in use, advancing tube 3, for forming packages 2; and
- conveying means 13 for advancing in a known manner web 4 along a respective web advancement path P from host station 6 to forming station 9, at which, in use, web 4 is formed into tube 3 and to advance tube 3 along a tube advancement path Q towards and through package forming unit 12.

In particular, isolation chamber 7 is arranged downstream of magazine unit 5 along path P.

In particular, package forming unit 12 is arranged downstream of isolation chamber 7 and tube forming device 8 along path Q.

Preferably, packaging machine 1 also comprises a sterilizing unit (not shown and known as such) adapted to sterilize the, in use, advancing web 4 at a sterilization station, in particular the sterilization station being arranged upstream of forming station 9 along path P.

Preferentially, conveying means 13 are adapted to advance tube 3 and any intermediate of tube 3 in a manner known as such along path Q, in particular from forming station 9 towards and at least partially through package forming unit 12. In particular, under intermediates of tube 3 any configuration of web 4 is meant prior to obtaining the tube structure and after folding of web 4 by tube forming device 8 has started. In other words, the intermediates of tube 3 are a result of the gradual folding of web 4 so as to obtain tube 3, in particular by overlapping the lateral respective edges of web 4 with one another.

Figure 2:
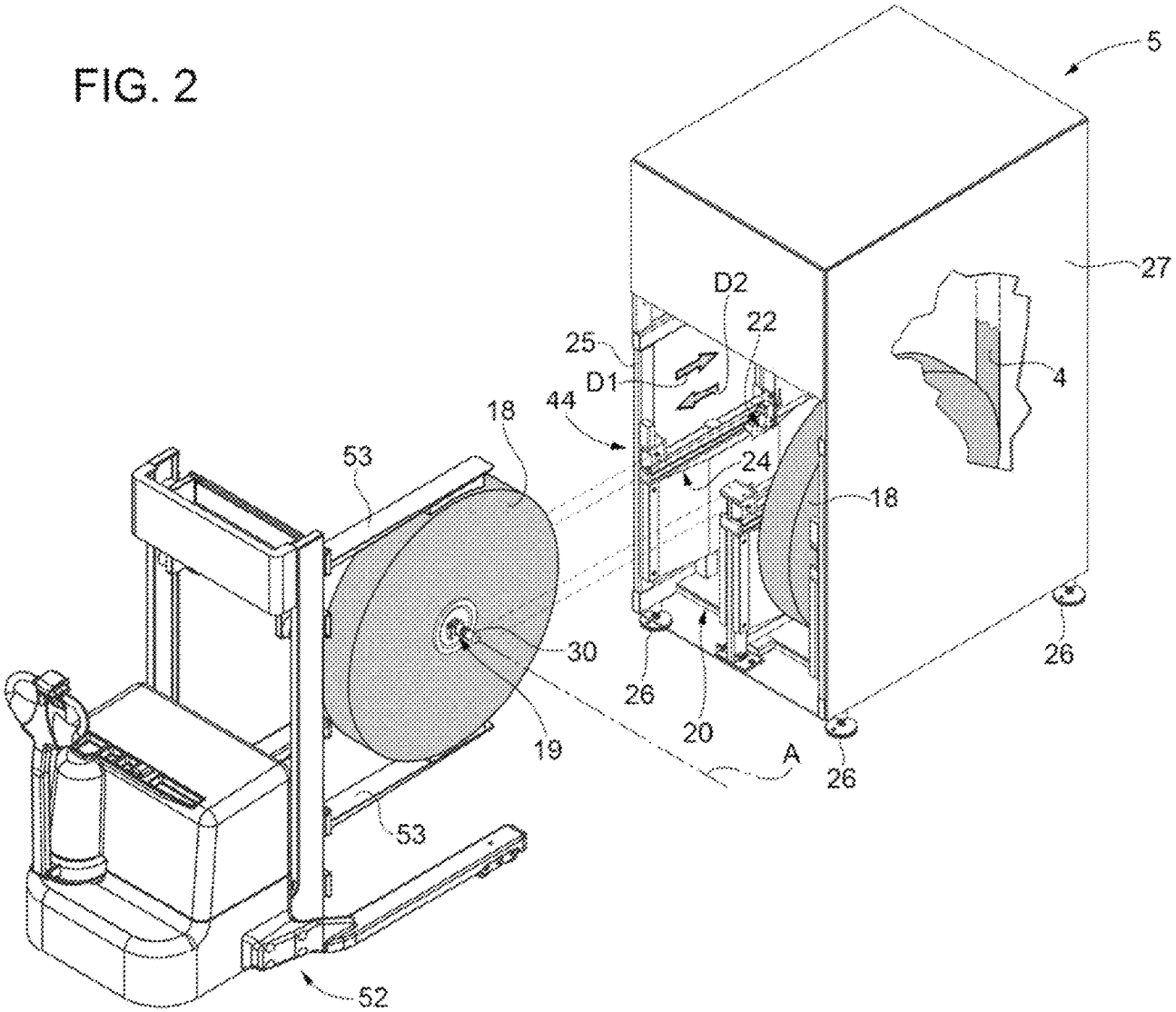
FIG. 2 is a perspective view of a detail of the packaging machine of FIG. 1 during a loading phase of the detail, with parts removed for clarity.

With particular reference to FIGS. 1 and 2, magazine unit 5 is configured to host at least one reel 18 of web 4. Preferentially, magazine unit 5 is configured to host two reels 18 of web 4.

Each reel 18 is formed from a wound-up web 4 and comprises a through-hole so as to receive a respective spindle 19.

In particular, magazine unit 5 is configured to receive and retain at least one spindle 19 carrying in a wound-up manner web 4 or in other words one spindle 19 carrying one respective reel 18.

Each spindle 19 extends along a central axis A.

In more detail, magazine unit 5 comprises:

an inlet opening 20 configured to allow for the introduction of at least one spindle 19 carrying wound-up web 4 (or in other words reel 18) into magazine unit 5; and at least one pair of housing seats 22 configured to rotatably and removably support (retain) one respective spindle 19 carrying wound-up web 4; in particular spindle 19 being supported by the respective pair of housing seats 22 is configured to rotate around the respective axis A.

Preferentially, magazine unit 5 comprises two pairs of housing seats 22 so as to allow for rotatably and removably supporting two spindles 19 carrying the respective web 4 contemporaneously so as to allow for a continuous operation of packaging machine 1 in a manner known as such and not further explained.

With particular reference to FIGS. 1 and 2, the respective housing seats 22 of each pair of housing seats 22 are arranged side-by-side and distanced from inlet opening 20, in particular so as to allow to position the wound-up web 4 (i.e. reel 18) within magazine unit 5. In other words, housing seats 22 are placed within an inner portion of magazine unit 5.

Preferentially, housing seats 22 are arranged such that with the respective spindle 19 being supported by the respective pair of housing seats 22, axis A is transversal, in particular perpendicular to the longitudinal axis of tube forming device 8, even more particular axis A having a horizontal orientation.

Advantageously, magazine unit 5 also comprises at least one pair 23 of guide rails 24, preferentially two pairs 23 of guide rails 24 each one being associated to one respective pair of housing seats 22.

In more detail, the respective guide rails 24 of each pair 23 are arranged side-by-side and each guide rail 24 extends along a respective axis B (see FIGS. 3 and 4) from inlet opening 20 to one respective housing seat 22. Each pair 23 of guide rails 24 is configured to guide spindle 19 in a direction D1, in particular parallel to axis B, from inlet opening 20 to the respective pair of housing seats 22 and, preferentially also to guide spindle 19 in a direction D2 opposite to direction D1 from the respective pair of housing seats 22 to inlet opening 20. In other words, pair 23 of guide rails 24 allow for directing spindle 19 from inlet opening 20 to the respective pair of housing seats 22 during loading of magazine unit 5 and, preferentially from the respective pair of housing seats 22 to inlet opening 20 during unloading of spindle 19. This allows to place spindle 19 carrying wound-up web 4 into magazine unit 5 and the respective pair of housing seats and, preferentially also to remove spindle 19 from magazine unit 5 and the respective pair of housing seats (in particular, after partial or complete consumption of wound-up web 4).

Preferentially, each guide rail 24 extends along the respective longitudinal axis B, in particular transversal, even more particular orthogonal to axis A when, in use, spindle 19 is supported by the respective pair of housing seats 22. Even more preferentially, axis B has a substantial horizontal orientation.

By providing for pair 23 of guide rails 24, it is possible to avoid to provide for a cart comprising side arms, each having an extension sufficient to place spindle 19 directly into the respective pair of housing seats 22, inside magazine unit 5. By providing for guide rails 24 it is possible to place spindle 19 into the respective pair 23 of guide rails 24 and to transfer spindle 19 to the respective pair of housing seats 22.

Preferentially, each pair 23 of guide rails 24 is also configured to allow for guiding movement of spindle 19 during the removal of spindle 19 away from magazine unit 5.

More specifically, the respective guide rails 24 of each pair 23 are arranged parallel to one another; i.e. the distance between and transversal to guide rails 24 themselves is constant.

Preferentially, magazine unit 5 comprises a support frame 25 carrying housing seats 22 and guide rails 24 and delimiting inlet opening 20. Even more preferentially, magazine unit 5 also comprises elevation adjustment means, in particular moveable feet elements 26, connected to support frame 25, and being configured to locally control elevation of support frame 25.

Preferably, magazine unit 5 also comprises a cover 27 supported by support frame 25 and delimiting an inner space of magazine unit 5 from an outside space. In particular, each pair of housing seats 22 and each pair 23 of guide rails 24 being arranged within the inner space.

With particular reference to FIGS. 1 to 4, each guide rail 24 is configured to interact with one respective engagement portion 30 (only one shown) of spindle 19 (in other words, in use, the respective engagement portion 30 is engaged to the respective guide rail 24). In a preferred embodiment, each engagement portion 30 coincides with a respective end portion of spindle 19. In particular, the transversal distance between the two guide rails 24 substantially corresponds to the length of the respective spindle 19.

More specifically, each guide rail 24 comprises a respective first end 31 and a respective second end 32 opposite to the respective first end 31.

Even more specifically, each second end 32 is arranged adjacent to the respective housing seat 22 and each first end 31 is arranged in the area of inlet opening 20.

Preferentially, each guide rail 24 comprises at least one first guiding surface 33 configured to guide (support) a respective engagement portion 30 of spindle 19, in particular to the respective housing seat 22. Even more preferentially, each first guiding surface 33 extends from the respective first end portion 31 to the respective second end portion 32.

In particular, in use, spindle 19, in particular the respective engagement portions 30, rolls over the respective guiding surface 33 when being guided from inlet opening 20 to the respective housing seats 22 (see FIGS. 3 and 4) or when being guided from the respective housing seats 22 to outlet opening 20.

Preferably, each first guiding surface 33 comprises an initial portion 34 arranged in the proximity of inlet opening 20 and a main portion 35 extending to the respective housing seat 22. In other words, each initial portion 34 carries (comprises) at least one section of the respective end portion 31 and each main portion 35 carries (comprises) at least one section of the respective end portion 32.

Even more preferably, each first guiding surface 33 comprises also an intermediate portion 36 interposed between the respective initial portion 34 and the respective main portion 35.

In particular, in use, while spindle 19 is introduced into magazine unit 5 and prior to being guided to the respective housing seats 22, spindle 19, in particular the respective engagement portions 30, becomes at first placed on (engaged to) the respective initial portions 34.

Preferentially, initial portions 34 are inclined with respect to the respective main portions 35 and are configured to arrange spindle 19 in an initial position.

Even more preferentially, each guide rail 24 also comprises an abutment surface 37 arranged in the area of the respective first end portion 31, in particular being part of the respective first end portion 31, so as to define in cooperation with the respective initial portion 34 the respective initial position. In this way, it is ensured that spindle 19 is not guided to the respective housing seats 22 in an uncontrolled manner.

Preferably, each initial portion 34 descends from (within the proximity of) the respective intermediate portion 36 to the respective abutment surface 37 (i.e. each initial portion 34 has a downward slope). Thus, in use, when the respective spindle 19 is placed on the respective initial portions 34, the respective spindle 19 rolls towards the respective abutment surface 37.

Preferably, each main portion 35 descends from (within the proximity of) the respective intermediate portion 36 to the respective housing seat 22, in particular the downward slope from (within the proximity of) the respective intermediate portion 36 to the respective housing seat 22 ranging between −1° to −5°, even more particular between −1° to −3°. The downward slope allows to facilitate the guidance of spindle 19 carrying in a wound-up manner web 4 towards and to the respective housing seats 22.

In a preferred embodiment, each guide rail 24 comprises a respective support plate 38 mounted to support frame 25 and carrying the first respective guiding surface 33 and the respective abutment surface 37.

In a preferred embodiment, each first guiding surface 33 is of a polymeric material.

Figure 3:
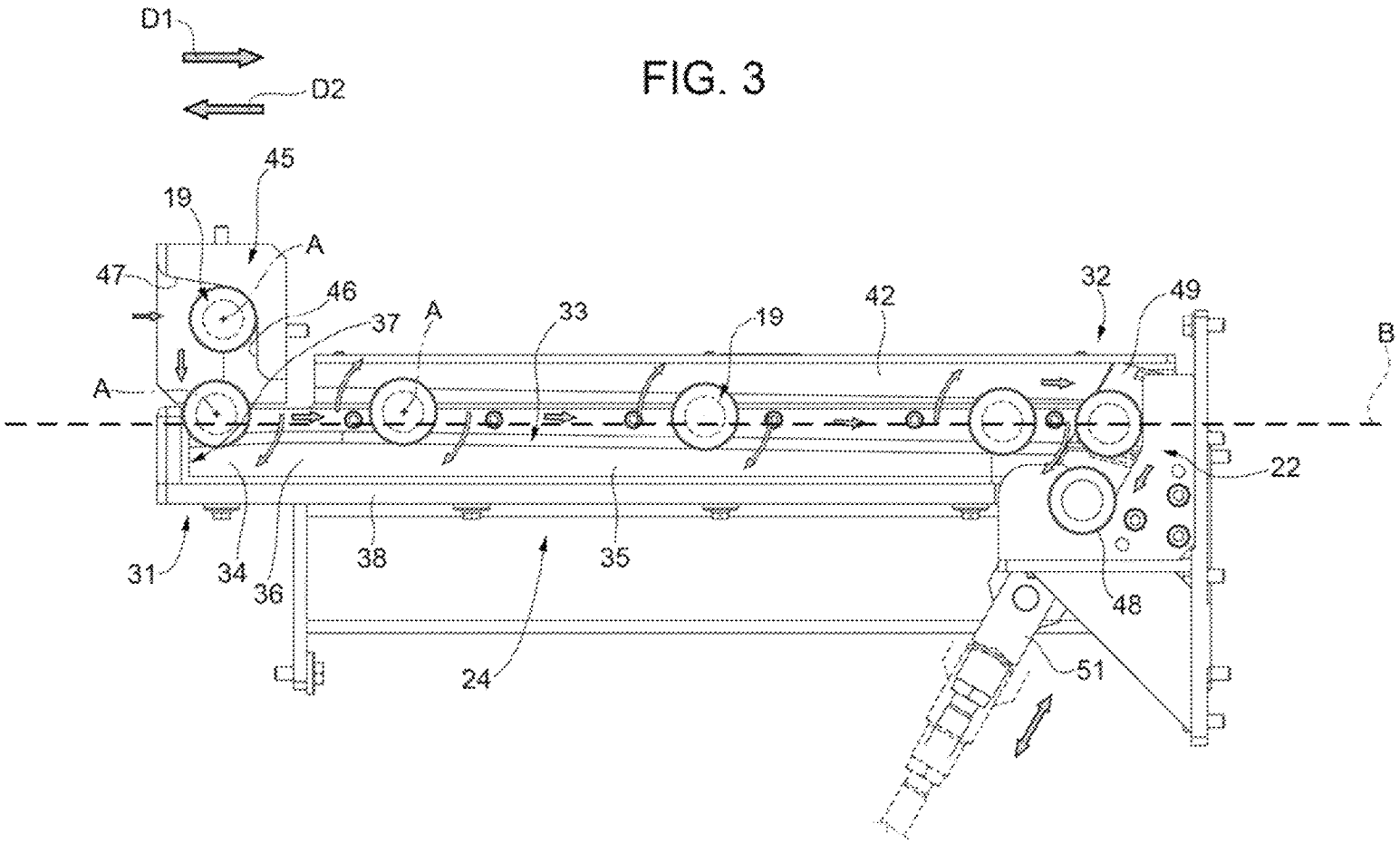
FIG. 3 is a side view of a component of the detail of FIG. 2, with parts removed for clarity.
Figure 4:
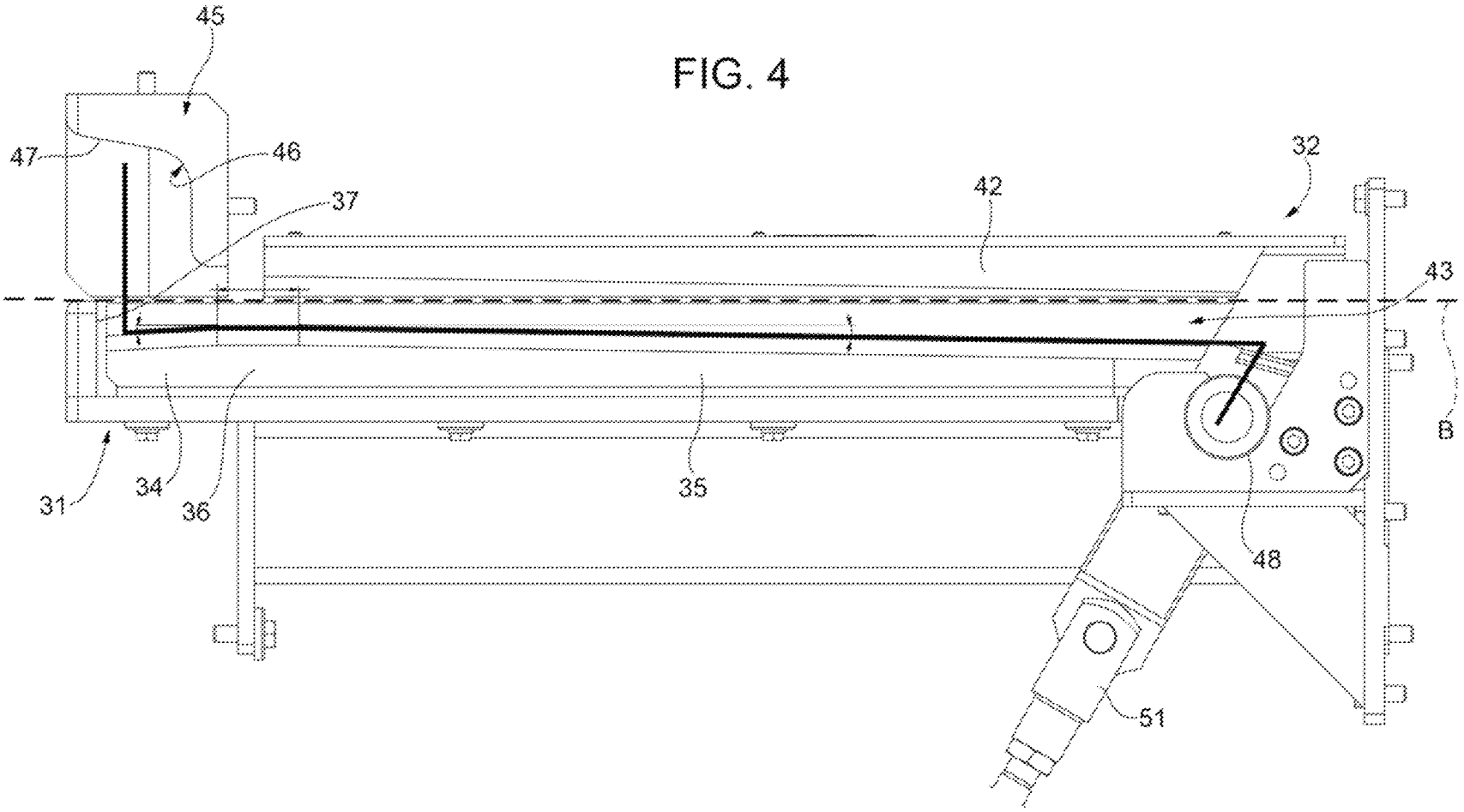
FIG. 4 is another side view of the component of FIG. 3, with parts removed for clarity.

With particular reference to FIGS. 3 and 4, each guide rail 24 comprises at least one second guiding surface 42 being at least arranged side-by-side to and facing the respective main portion 35 (i.e. each second guiding surface 42 is parallel to the respective first guiding surface 33). In particular, each second guiding surface 42 is configured to constrain at least in cooperation with the respective main portion 35 movement of spindle 19 towards or away from the respective pair of housing seats 22. In other words, each second guiding surface 42 delimits movement of spindle 19, in particular of the respective engagement portion 30, into a direction orthogonal to the respective main portion 35.

Preferably, each second guiding surface 42 defines together with the respective first guiding surface 33, in particular the respective main portion 35, a guiding channel 43 of the respective guide rail 24 for guiding the respective engagement portion 30 towards or away from the respective housing seat 22.

With particular reference to FIGS. 2 to 4, magazine unit 5 further comprises at least one pair 44 of insertion limit surfaces 45, preferentially two pairs of insertion limit surface 45, each pair 44 of insertion limit surface 45 being associated to one respective guide rail 24.

Each pair 44 of insertion limit surfaces 45 is configured to delimit movement of the respective spindle 19, in particular prior to engagement of the respective spindle 19 to the respective guide rail 24, along direction D1 parallel to the respective longitudinal axis B and towards the respective pair of housing seats 22.

Each insertion limit surface 45 is arranged in the area of inlet opening 20 and is transversally distanced from (radially distanced with respect to the respective axis B), in particular, is arranged above, the respective first end portion 31 of the respective guide rail 24, even more particular the respective initial portion 34 of the respective guiding surface 24.

In particular, each pair 44 of insertion limit surfaces 45 is configured to guarantee that, in use and during the insertion of a respective spindle 19 into magazine unit 5, spindle 19, in particular the respective engagement portions 30, is/are at first placeable onto the respective initial portions 34. In other words, insertion limit surface 45 are configured to avoid that spindle 19, in particular the respective engagement portions 30, may be placed onto the respective main portions 35 in such a way that spindle moves in a non-controlled manner towards and into housing seats 22.

In more detail, each insertion limit surface 45 comprises an abutment portion 46 transversally distanced from the respective initial portion 35 and being configured to delimit the position of the respective spindle 19 along direction D1. Preferably, each insertion limit surface 45 also comprises a guidance portion 47 transversal to the respective abutment portion 46 and extending from inlet opening 20 to the respective abutment portion 46 and being configured to guide spindle 19 towards the respective abutment portion 46. In other words, each guidance portion 47 faces at least one portion of the respective initial portion 34.

In a preferred embodiment, each insertion limit surface 45 is mounted to support frame 25.

Figure 5:
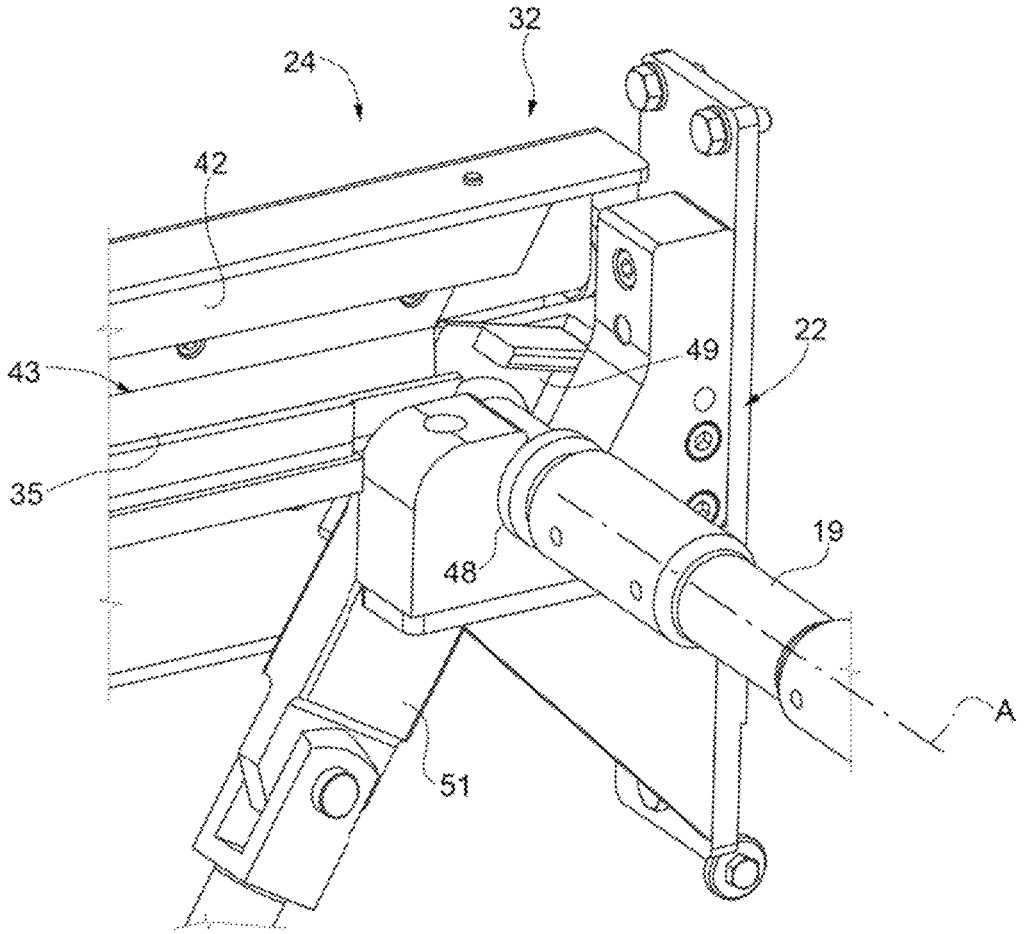
FIG. 5 is an enlarged perspective view of a specific detail of the component of FIGS. 3 and 4, with parts removed for clarity.

With particular reference to FIGS. 3 and 5, each pair of housing seats 22 is controllable between a receiving configuration in which the pair of housing seats 22 is configured to receive and/or to release the respective spindle 19 and a locking configuration in which the pair of housing seats 22 is configured to allow for rotation of the respective spindle 19 around axis A and to block any linear movement of the respective spindle 19.

Preferentially, each housing seat 22 comprises a fixed seat portion 48 configured to house at least one first section of the respective spindle 19 with the respective housing seat 22 being controlled in the locking configuration and a moveable seat portion 49 being configured to move between an extracted position in which the moveable seat portion 49 is configured to receive at least one second section of the respective spindle 19 and in a retracted position for placing at least the first section of the respective spindle 19 in the respective fixed seat portion 48.

In particular, each pair of housing seats 22 is controlled in the respective receiving configuration and the respective locking configuration with the respective moveable seat portions 49 being respectively in the respective extracted position and in the respective retracted position.

By providing a fixed seat portion 48 and a moveable seat portion 49 of each housing seat 22 and by placing the respective spindle 19 in the respective fixed seat portion 48 during operation of packaging machine 1 it is guaranteed to have a precise and robust advancement of web 4 from the respective spindle 19.

Preferentially, magazine unit 5 comprises an actuation device adapted to control moveable seat portions 49 between the extracted position and the retracted position so as to control each pair of housing seats 22 between the receiving configuration and the locking configuration.

Even more preferentially, the actuation device comprises a plurality of actuators 51 (only one shown), each one connected to one respective moveable seat portion 49 and being configured to move the respective moveable seat portion 49 between the respective extracted position and the respective retracted position.

Preferentially, magazine unit 5 also comprises at least one pair of sensor devices (not specifically shown), in particular two pair of sensor devices, each pair of sensor devices being associated to one respective pair of housing seats 22.

More specifically, each sensor device, e.g. being a proximity sensor, is associated to one respective moveable seat portion 49 and is configured to detect and/or determine the correct insertion of at least the second section into the moveable seat portion 49 with the moveable seat portion 49 being in the extracted position.

Preferentially, the actuation device is configured to simultaneously move the respective moveable seat portions 49 of one respective pair of housing seats 22 from the respective extracted position to the respective retracted position if, in use, both sensor devices of the respective pair of sensor devices detect and/or determine the correct insertion of the respective second section.

In use, packaging machine 1 forms packages 2 filled with the pourable product.

In more detail, conveying means 13 advance web 4 from magazine unit 4 along advancement path P. In particular, during advancement of web 4 along advancement path P web 4 is unwound from a respective spindle 19, the respective spindle 19 rotating around the respective axis A.

In further detail, conveying means 13 advance web 4 to forming station 9 at which web 4 is formed into tube 3. Then conveying means 13 further advance tube 3 along path Q to package forming unit 12. During the advancement of tube 3, filling means 11 fill tube 3 with the pourable product.

Package forming unit 12 forms and transversally seals tube 3 and, preferentially, also transversally cuts tube 3 so as to obtain packages 2.

Preferentially, conveying means 13 advance web 4 by unwinding web 4 from one spindle 19 being placed within the respective pair of housing seats 22.

Prior to operation of packaging machine 1 it is possible to execute a loading process of magazine unit 5 during which at least one spindle 19 carrying in a wound-up manner web 4 is placed within magazine unit 5. In particular, as in the preferred embodiment magazine unit 5 comprises two pairs of housing seats 22 it is possible to also place another spindle 19 carrying in a wound-up manner web 4 during the operation of packaging machine 1.

The loading of magazine unit 5 comprises at least the steps of:

- engaging one respective spindle 19 carrying wound-up web 4 to the respective pair 23 of guide rails 24;
- moving the respective spindle 19 towards and to the respective pair of housing seats 22 while the respective spindle 19 is guided by the respective pair 23 of guide rails 24; and
- inserting the respective spindle 19 into the respective pair of housing seats 22.

In more detail, during the step of engaging, the respective engagement portions 30 of spindle 19 are placed onto the respective initial portions 34 of the respective guide rails 24. As each initial portion 34 is inclined with respect to the respective main portion 35, in particular declining from the respective intermediate portion 36 to the respective abutment surface 37 with a downward slope, the respective spindle 19 is biased into the respective initial position.

In even further detail, during the step of engaging and, in particular prior to placing the respective engagement portions 30 onto the respective initial portions 34, the respective spindle 19 carrying the wound-up web 4 (or in other words, carrying one respective reel 18), in particular the respective engagement portions 30, is/are placed transversally displaced from (radially displaced from with respect to the respective axis B), in particular above, initial portion 34. In particular, the respective spindle 19 is moved towards inlet opening 20 and is directed along direction D1 through inlet opening 20 into magazine unit 5. At some point during directing the respective spindle along direction D1, the respective spindle 19 interacts with the respective pair 44 of insertion limit surface 45 so as to guarantee to place the spindle 19, in particular the respective engagement portions 30, transversally displaced from (radially displaced with respect to the respective axis B), in particular, above, the respective initial portions 34. Then, the respective spindle 19, in particular the respective engagement portions 30, can be placed onto the respective initial portions 34, in particular by lowering the respective spindle 19.

Preferentially, during the step of engaging, spindle 19 and wound-up web 4 are handled by a cart 52 having two parallel handling arms 53 (see FIG. 2). In particular, the wound-up web 4 (or in other words, the respective reel 18) is clamped between the two handling arms 53, even more particular such that the respective axis A of the respective spindle 19 has a horizontal orientation.

Even more preferentially, prior to the step of engaging, cart 52 is loaded.

More specifically, during a step of loading of cart 52, at first one respective reel 18 is clamped between the respective handling arms 53 and then the respective spindle 19 is guided through the respective through-hole of the respective reel 18.

Even more specifically, the respective reel 18 is stored without the respective spindle 19 such that the respective central axis defined by the respective through-hole has a vertical orientation. In particular, the respective reel 18 is stacked with other reels 18. Thus, at first the respective reel 18 is clamped between the respective handling arms 53, preferentially is removed from the stack, and then a rotation of about 90° of the respective reel 18 is actuated by rotation of the respective handling arms 53. Then the respective spindle 19 is introduced through the respective through-hole.

In more detail, during the step of moving, the respective engagement portions 30 of the respective spindle 19 are rolled, in particular by an operator, from the respective initial portions 34 over the respective main portions 35 to the respective housing seats 22. In particular, during the rolling over the respective main portions 35, the rolling action is facilitated by providing for a downward slope of the respective main portions 35 from the respective intermediate portions 36 to the respective housing seats 22.

Preferentially, the loading process of magazine unit 5 also comprises the additional steps of:

- controlling the respective pair of housing seats into the receiving configuration executed prior to the step of inserting; and
- controlling the pair of housing seats 22 into the locking configuration after execution of the step of inserting.

In this way, it is possible to obtain a precise and secure advancement of web 4 as the respective spindle 19 only rotates during the advancement of web 4 around the respective axis A and any linear movement is suppressed.

In more detail, during the step of controlling the respective pair of housing seats 22 in the respective receiving configuration, the respective moveable seat portions 49 are moved, in particular by operation of the actuation device, in the respective extracted position; and during the step of controlling the respective pair of housing seats 22 in the locking configuration the respective moveable seat portions 49 are moved, in particular by operation of the actuation device, into the respective retracted positions.

Preferentially, the loading process of magazine unit 5 also comprises the additional step of detecting and/or determining whether the respective spindle 19 is correctly placed within the respective pair of housing seats 22.

In more detail, during the step of detecting and/or determining, the respective sensor devices detect whether the respective spindle 19, in particular respective second sections of the spindle 19, are correctly placed within the respective moveable seat portions 49.

Preferentially, the step of controlling the respective pair of housing seats 22 into the respective locking configuration is only executed if the respective spindle 19 is correctly placed within the respective pair of housing seats 22, i.e. only if the respective second sections of the respective spindle 19 are correctly placed within the respective moveable seat portions 49.

The advantages of magazine unit 5 according to the present invention will be clear from the foregoing description.

In particular, by providing for pair 23 of guide rails 24 it is possible to avoid to use two handling carts during the loading of magazine unit 5. Handling cart 52 is sufficient to remove the respective reel 18 from the stack of reel 18, to carry the respective reel and to engage the respective spindle 19 to the respective pair 23 of guide rails 24. Otherwise, the dimensions of handling cart 52 and the spaces present within magazine unit 5 would not allow to place the respective spindle 19 directly into the respective pair of housing seats 22.

A further advantage resides in providing for a first guiding surface 33 having an initial portion 34 and a main portion 35. This allows an operator to easily control the transfer of the respective spindle 19 carrying the wound-up web 4 into the respective pair of housing seats 22. This is even further facilitated by providing for the respective downward slopes.

Clearly, changes may be made to magazine unit 5 as described herein without, however, departing from the scope of protection as defined in the accompanying claims.

The invention claimed is:

1. A magazine unit for a packaging machine comprising:

an inlet opening configured to allow for the introduction of a spindle carrying a wound-up web of packaging material into the magazine unit;

at least one pair of housing seats configured to rotatably support the spindle carrying the wound-up web of packaging material, the respective housing seats being arranged side-by-side and distanced from the inlet opening;

a pair of guide rails, the guide rails being arranged side-by-side and each one extending from the inlet opening to one respective housing seat and being configured to guide the spindle from the inlet opening to the pair of housing seats;

each one of the guide rails extending along a respective longitudinal axis and having a respective first end portion and a respective second end portion opposite to the first end portion;

the second end portion of each guide rail being arranged adjacent to the respective housing seat;

a pair of insertion limit surfaces arranged adjacent the inlet opening, each of the insertion limit surfaces being transversally distanced from the first end portion of a respective one of the guide rails;

the pair of insertion limit surfaces being configured to delimit movement of the spindle along a direction parallel to the longitudinal axis of the respective guide rail and towards the pair of housing seats.

2. The magazine unit according to claim 1, wherein each guide rail comprises at least one first guiding surface, each one configured to guide a respective engagement portion of the spindle;

wherein each first guiding surface comprises an initial portion arranged in the proximity of the inlet opening and a main portion extending to the respective housing seat;

wherein the initial portions are inclined with respect to the respective main portion and are configured to bias the spindle in an initial position.

3. The magazine unit according to claim 2, wherein each first guiding surface also comprises an intermediate portion interposed between the respective main portion and the respective initial portion;

wherein the main portion descends from the intermediate portion to the respective housing seat.

4. The magazine unit according to claim 3, wherein each guide rail also comprises an abutment surface arranged at a first end portion of the respective guide rail; and wherein the initial portion descends from the respective intermediate portion to the respective abutment surface.

5. The magazine unit according to claim 2, wherein each guide rail comprises at least one second guiding surface arranged side-by-side to and facing the respective main portion;

wherein at least each second guiding surface and the respective main portion define a respective guiding channel of the respective guide rail;

wherein each guiding channel is configured to constrain movement of the respective spindle towards and away from the respective pair of housing seats.

6. The magazine unit according to claim 1, wherein the pair of housing seats is controllable between a receiving configuration in which the pair of housing seats is configured to receive the spindle and a locking configuration in which the pair of housing seats is configured to allow for rotation of the spindle around a longitudinal axis (A) of the spindle and to block any linear movement of the spindle.

7. The magazine unit according to claim 6, wherein each housing seat comprises a fixed seat portion configured to house at least one first section of the spindle with the respective pair of housing seats being controlled in the locking configuration and a moveable seat portion being configured to move between an extracted position in which the moveable seat portion is configured to receive at least one second section of the respective spindle and a retracted position for placing at least the first section of the respective spindle in the fixed seat portion;

wherein the pair of housing seats is controlled in the receiving configuration and the locking configuration with the respective moveable seat portions being respectively in the respective extracted positions and in the respective retracted positions.

8. The magazine unit according to claim 7, and further comprising:

an actuation device coupled to each moveable seat portion and being configured to move each moveable seat portion between the retracted position and the extracted position;

wherein the actuation device is configured to simultaneously move the respective moveable seat portions from the extracted position to the retracted position if correct insertion of the respective section of the spindle is detected and/or determined.

9. The magazine unit according to claim 1, wherein each insertion limit surface comprises an abutment portion transversally distanced from the respective guide rail and configured to delimit a position of the spindle along the direction parallel to the longitudinal axis of the respective guide rail, each insertion limit surface also comprising a guidance portion transverse to the abutment portion and extending from inlet opening to the abutment portion, the guidance portion facing towards a respective guide rail and being configured to guide the spindle towards the abutment portion.

10. The magazine unit according to claim 1, wherein each insertion limit surface comprises an abutment portion and a guidance portion, the abutment portion being transversally distanced from the respective guide rail, the abutment portion including a surface facing towards the inlet opening and positioned to be contacted by the spindle while the spindle is moving along the direction parallel to the longitudinal axis of the respective guide rail to delimit a position of the spindle along the direction parallel to the longitudinal axis of the respective guide rail, the guidance portion being transversally distanced from the respective guide rail and facing towards the respective guide rail, the guidance portion extending from inlet opening to the abutment portion to guide the spindle towards the abutment portion while the spindle is moving along the direction parallel to the longitudinal axis of the respective guide rail.

11. A packaging machine for producing sealed packages of a pourable product comprising:

an isolation chamber separating an inner environment from an outer environment;

a tube forming device at least partially arranged within the isolation chamber at a forming station and being adapted to form a tube from a web of packaging material;

a sealing device at least partially arranged within the isolation chamber and being adapted to longitudinally seal the tube formed by the tube forming device;

filling means for filling the tube with the pourable product;

a package forming unit adapted to form and to transversally seal the tube for forming the packages;

conveying means for advancing the web of packaging material along a web advancement path (P) from a host station to the forming station and for advancing the tube along a tube advancement path to the package forming unit;

a magazine unit according to claim 1 and providing for the web of packaging material at the host station.

12. A method for loading a magazine unit comprising:

moving a spindle carrying a wound-up web of packaging material in a movement direction towards an inlet opening of the magazine unit and through the inlet opening into the magazine unit, the magazine including a pair of guide rails each extending along a respective longitudinal axis, each guide rail having a respective first end portion and a respective second end portion opposite to the first end portion;

the moving of the spindle causing the spindle to interact with a pair of insertion limit surfaces each arranged adjacent the inlet opening and transversally distanced from the first end portion of a respective one of the guide rails to delimit the movement of the spindle in the movement direction which is parallel to the longitudinal axis of the respective guide rail and towards the pair of housing seats;

engaging the spindle carrying the wound-up web of packaging material to the pair of guide rails of the magazine unit, wherein each guide rail extends from the inlet opening of the magazine unit to a respective one of the housing seats of the magazine unit, the second end portion of each guide rail being arranged adjacent to the respective housing seat;

moving the spindle towards and to the pair of housing seats of the magazine unit while the spindle is guided by the pair of guide rails; and inserting the spindle into the pair of housing seats.

13. The method according to claim 12, wherein each guide rail comprises at least one first guiding surface, each one configured to guide a respective engagement portion of the spindle;

wherein each first guiding surface comprises an initial portion arranged in the proximity of the inlet opening and a main portion extending to the respective housing seat;

wherein each initial portion is inclined with respect to the respective main portion and is configured to bias the spindle into an initial position;

wherein during the engaging of the spindle to the pair of guide rails, the engagement portions of the spindle are placed onto the respective initial portions and are biased into the respective initial position;

wherein during the moving of the spindle, the respective engagement portions of the spindle are rolled from the respective initial portions over the respective main portions to the respective housing seats.

14. The method according to claim 12, wherein the pair of housing seats is controllable in a receiving configuration in which the pair of housing seats is adapted to receive the spindle and in a locking configuration in which the pair of housing seats is adapted to allow for rotation of the spindle around a central axis (A) and to block any linear movement of the spindle during rotation of the spindle around the central axis (A);

wherein the method further comprises:

controlling the pair of housing seats in the receiving configuration is executed prior to the inserting of the spindle into the pair of housing seats; and controlling the pair of housing seats in the locking configuration is executed after the inserting of the spindle into the pair of housing seats.

15. The method according to claim 14, and further comprising detecting and/or determining whether the spindle is correctly placed within the pair of housing seats;

wherein the controlling of the pair of housing seats in the locking configuration is executed if the spindle is correctly placed within the pair of housing seats.

16. The method according to claim 12, wherein each insertion limit surface comprises an abutment portion and a guidance portion, the interacting of the spindle with the pair of insertion limit surfaces comprising: i) the spindle being guided by the guidance portion of each insertion limit surface towards the respective abutment portion while moving in the movement direction parallel to the longitudinal axis of the respective guide rail; the spindle contacting the abutment surface of each insertion limit surface to stop the movement of the spindle in the movement direction, and further comprising moving the spindle toward the guide rails after the spindle contacts the abutment surface of each insertion limit surface.

17. A magazine unit for a packaging machine comprising:

a cover enclosing an inner space and delimiting the inner space from an outside space, the cover including a top and sides that enclose the inner space;

the cover including an inlet opening configured to allow a spindle carrying a wound-up web of packaging material to be introduced into the inner space;

at least one pair of housing seats positioned in the inner space and configured to rotatably support the spindle carrying the wound-up web of packaging material, the respective housing seats being arranged side-by-side and distanced from the inlet opening of the cover;

a pair of guide rails positioned in the inner space and arranged side-by-side, each of the guide rails extending from the inlet opening to a respective one of the housing seats and being configured to guide the spindle from the inlet opening to the pair of housing seats;

each of the guide rails extending along a respective longitudinal axis and having a respective first end portion and a respective second end portion opposite to the first end portion;

the second end portion of each guide rail being arranged adjacent to the respective housing seat;

a pair of insertion limit surfaces arranged adjacent the inlet opening, each of the insertion limit surfaces being transversally distanced from the respective first end portion of one respective guide rail; and the pair of insertion limit surfaces being configured to delimit movement of the spindle along a direction parallel to the longitudinal axis of the respective guide rail and towards the pair of housing seats.

18. The magazine unit according to claim 17, wherein each insertion limit surface comprises an abutment portion transversally distanced from the respective guide rail and configured to delimit a position of the spindle along the direction parallel to the longitudinal axis of the respective guide rail, each insertion limit surface also comprising a guidance portion transverse to the abutment portion and extending from inlet opening to the abutment portion, the guidance portion facing towards a respective guide rail and being configured to guide the spindle towards the abutment portion.

19. The magazine unit according to claim 17, wherein each insertion limit surface comprises an abutment portion and a guidance portion, the abutment portion being transversally distanced from the respective guide rail, the abutment portion including a surface facing towards the inlet opening and positioned to be contacted by the spindle while the spindle is moving along the direction parallel to the longitudinal axis of the respective guide rail to delimit a position of the spindle along the direction parallel to the longitudinal axis of the respective guide rail, the guidance portion being transversally distanced from the respective guide rail and facing towards the respective guide rail, the guidance portion extending from inlet opening to the abutment portion to guide the spindle towards the abutment portion while the spindle is moving along the direction parallel to the longitudinal axis of the respective guide rail.

* * * * *